US009788123B2

(12) United States Patent
Sha et al.

(10) Patent No.: US 9,788,123 B2
(45) Date of Patent: Oct. 10, 2017

(54) DOUBLE-VOICE COIL MOVING-COIL LOUDSPEAKER

(71) Applicant: Wenjin Sha, Zhongshan (CN)

(72) Inventors: Wenjin Sha, Zhongshan (CN); Yongming Wang, Zhongshan (CN)

(73) Assignee: Wenjin Sha, Zhongshan (CN)

( * ) Notice: Subject to any disclaimer, the term of this patent is extended or adjusted under 35 U.S.C. 154(b) by 39 days.

(21) Appl. No.: 14/890,780

(22) PCT Filed: Apr. 13, 2014

(86) PCT No.: PCT/CN2014/075229

§ 371 (c)(1),
(2) Date: Nov. 12, 2015

(87) PCT Pub. No.: WO2014/169793

PCT Pub. Date: Oct. 23, 2014

(65) Prior Publication Data

US 2016/0088397 A1 Mar. 24, 2016

(30) Foreign Application Priority Data

Apr. 16, 2013 (CN) ..... 2013 1 0131450

(51) Int. Cl.
*H04R 1/00* (2006.01)
*H04R 9/02* (2006.01)
(Continued)

(52) U.S. Cl.
CPC ..... *H04R 9/025* (2013.01); *H04R 9/045* (2013.01); *H04R 9/06* (2013.01); *H04R 9/063* (2013.01); *H04R 2209/041* (2013.01)

(58) Field of Classification Search
CPC ..... H04R 9/022; H04R 2209/029; H04R 2209/041; H04R 2209/024
(Continued)

(56) References Cited

U.S. PATENT DOCUMENTS 3,665,124 A * 5/1972 Sotome ..... H04R 9/063 181/171
4,438,297 A * 3/1984 Kawamura ..... H04R 9/063 381/401

(Continued)

*Primary Examiner* — Curtis Kuntz
*Assistant Examiner* — Ryan Robinson
(74) *Attorney, Agent, or Firm* — Honigman Miller Schwartz and Cohn LLP

(57) ABSTRACT

A double-voice coil moving-coil loudspeaker comprises a bracket. A U-shaped cup with a circular groove is fixed in the bracket. A vibrating diaphragm is fixed on the bracket at the position of the U-shaped cup. A large voice coil and a small voice coil distributed in a concentric circle are arranged on the vibrating diaphragm. A circular large magnet and a circular small magnet distributed in a concentric circle are arranged in the U-shaped cup. A circular big washer and a circular small washer are respectively arranged on an upper surface of the large magnet and the small magnet. The big voice coil and the small voice coil are respectively arranged in a gap formed by the U-shaped cup and the big washer and a small gap formed between the U-shaped cup and the small washer. The U-shaped cup is provided with air vents. The air vents of the U-shaped cup are communicated with a gap between the big washer and the smaller washer and a gap between the big magnet and the small magnet. The invention has the benefit of improving sound quality while reducing the cost of manufacturing.

5 Claims, 11 Drawing Sheets

(51) Int. Cl.
*H04R 9/06* (2006.01)
*H04R 9/04* (2006.01)

(58) Field of Classification Search
USPC ..... 381/401
See application file for complete search history.

(56) References Cited

U.S. PATENT DOCUMENTS

| | | | | |
|---|---|---|---|---|
| 6,031,925 | A * | 2/2000 | Shteyn | H04R 9/063 181/171 |
| 7,551,749 | B2 * | 6/2009 | Rosen | B60R 11/0217 381/186 |
| 7,684,586 | B2 * | 3/2010 | Shimamura | H04R 31/006 381/398 |
| 7,907,742 | B2 * | 3/2011 | Nakajima | H04R 9/022 381/152 |
| 8,385,581 | B2 * | 2/2013 | Li | H04R 9/06 381/401 |
| 2004/0071307 | A1 * | 4/2004 | Chang | H04R 9/06 381/396 |

* cited by examiner

DOUBLE-VOICE COIL MOVING-COIL LOUDSPEAKER

TECHNICAL FIELD

The present invention relates to an electroacoustic conversion device, and more particularly, to a moving-coil loudspeaker with two (inner and outer) voice coils.

BACKGROUND

Present loudspeakers are single-voice coil structures generally, while requirement on the rigidity of a vibrating diaphragm is higher when the vibrating diaphragm is working. Distortion caused by broken vibrating is easily occurred since the present material technology cannot satisfy the requirements of high rigidity, light mass and good damping at the same time. Therefore, the performances of the loudspeakers cannot be improved all the time.

The State Intellectual Property Office of China discloses patents files with publication No. of "CN201657287U" and "CN201854415U", which disclose double-magnetic system double-voice coil loudspeaker structure, which achieves such advantages as higher driving force, higher magnetic steel utilization ratio and facilitating lighting and thinning of products to a certain extent, but it does not help too much to solve the distortion.

SUMMARY

As described above, the problem on aspect of distortion and frequency response caused by insufficient rigidity of a vibrating diaphragm is easily occurred in a common single-voice coil loudspeaker. The double-voice coil loudspeaker disclosed at present improves the defects of the single-voice coil loudspeaker, but cannot release air pressure at the back of the diaphragm; when the air pressure is reacted upon the diaphragm, a defect of larger distortion will be caused to the loudspeaker.

According to the present invention, the air pressure at the back of the diaphragm is released through arranging a discharge hole on a magnetic circuit system, thus reducing the distortion of the loudspeaker.

The object of the present invention is to provide a double-voice coil moving-coil loudspeaker, which effectively solves the problem of distortion caused by the air compression at the back of the diaphragm, thus increasing the sound quality effects, and improving the product quality.

DETAILED DESCRIPTION

Figure 1:
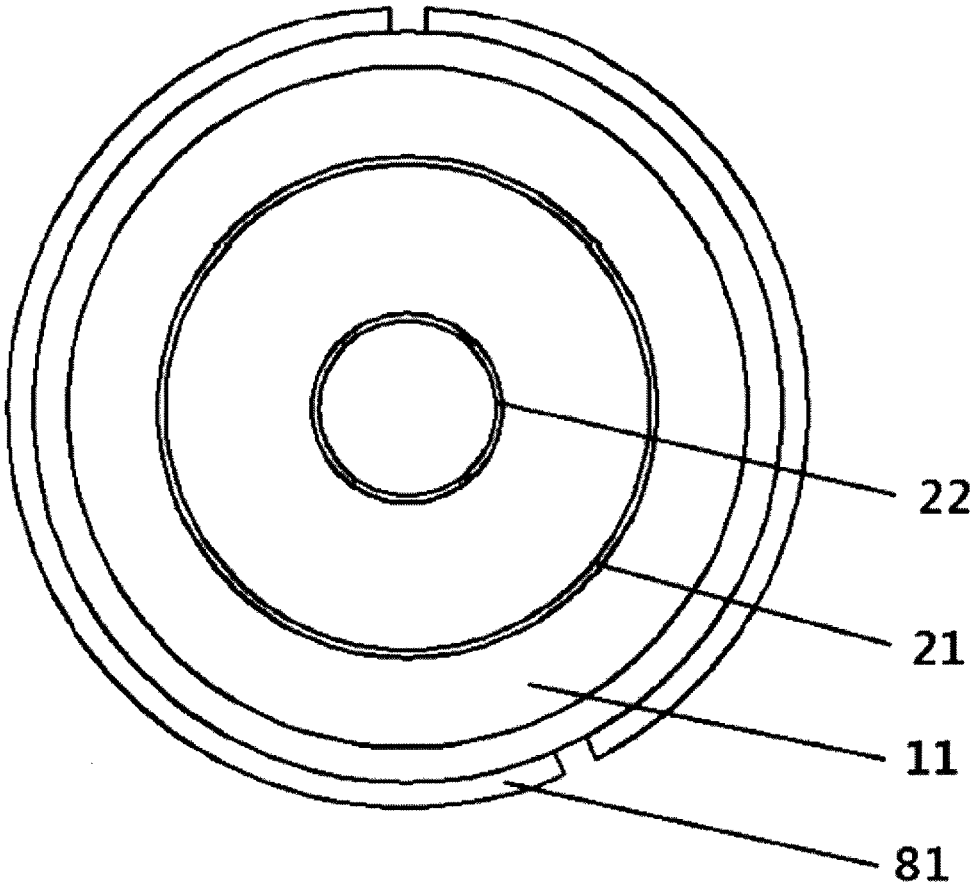
FIG. 1 is a front view of the present invention.
Figure 2:
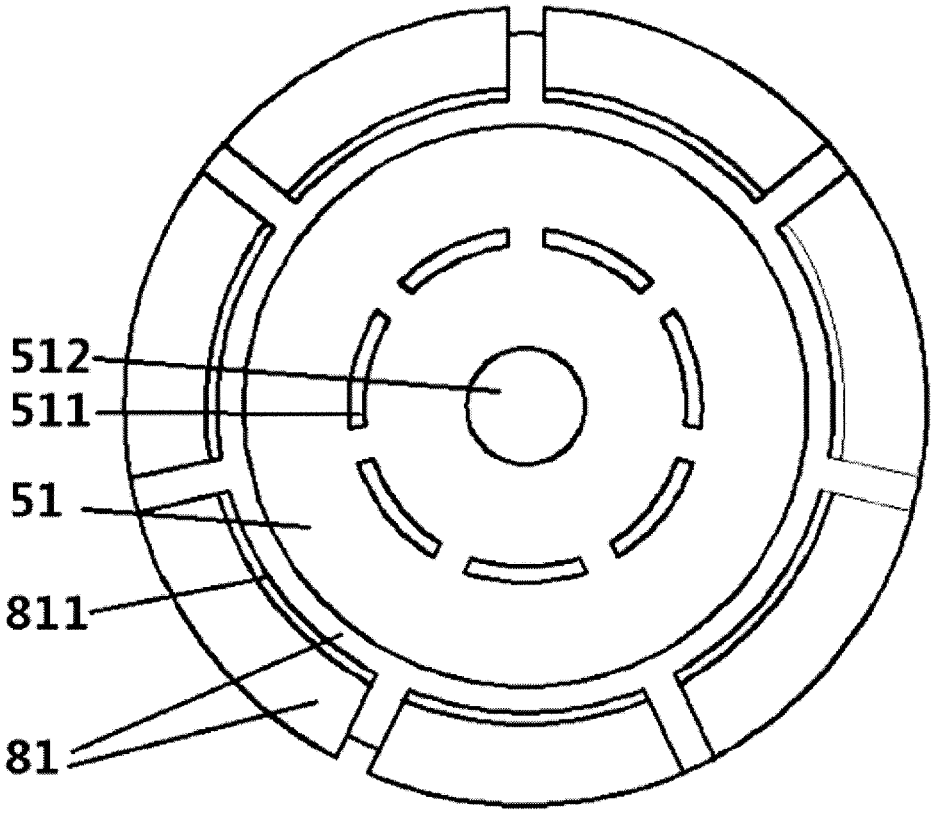
FIG. 2 is a rear view of the present invention.
Figure 3:
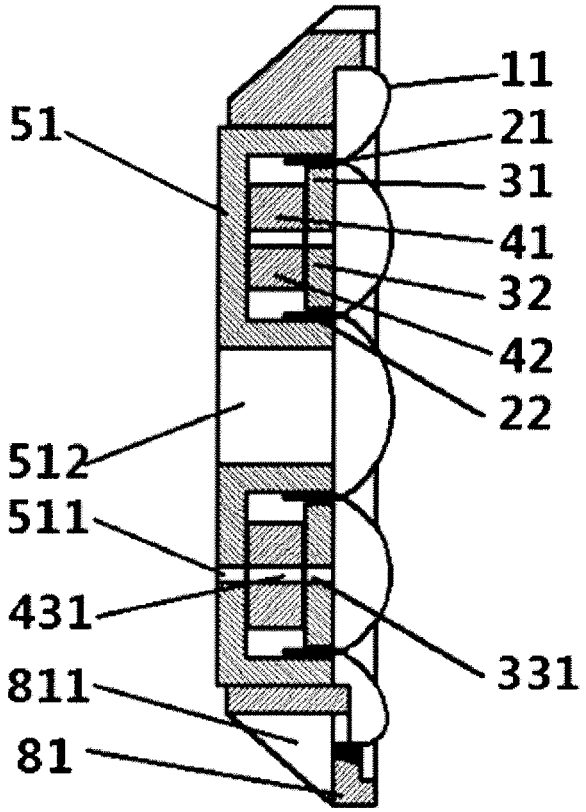
FIG. 3 is a broken view of FIG. 1.

The preferred embodiments of the present invention are as shown in FIG. 1, FIG. 2 and FIG. 3. A hole 512 is arranged at the center of a U-shaped cup 51 and a plurality of holes 511 are arranged at the periphery. The U-shaped cup 51 and a diaphragm 11 are arranged on a bracket 81. A big voice coil 21 and a small voice coil 22 distributed in a concentric circle are arranged on the diaphragm 11. A large magnet 41 and a small magnet 42 distributed in a concentric circle are arranged in the U-shaped cup 51. A big washer 31 and a small washer 32 distributed in a concentric circle are respectively arranged on an upper surface of the large magnet 41 and an upper surface of the small magnet 42. The large magnet 41, the small magnet 42, the big washer 31 and the small washer 32 are arranged between the big voice coil 21 and the small voice coil 22. The big voice coil 21 and the small voice coil 22 are respectively arranged in a gap formed by the U-shaped cup 51, the large magnet 41 and the big washer 31, and a gap formed by the U-shaped cup 51, the small magnet 42 and the small washer 32. A gap 431 between the large magnet 41 and the small magnet 42, and a gap 331 between the big washer 31 and the small washer 32 are corresponding to the hole 511 on the upper surface of the U-shaped cup 51, to form an air leakage path. When the diaphragm 11 is vibrating, the air at the back of the diaphragm is released through the hole 512, the gaps 331 and 431, the hole 511 and a gap 811 on the bracket 81, in this way, air compression will not be caused when the diaphragm 11 is vibrating, thus being capable of reducing loudspeaker distortion.

Figure 4:
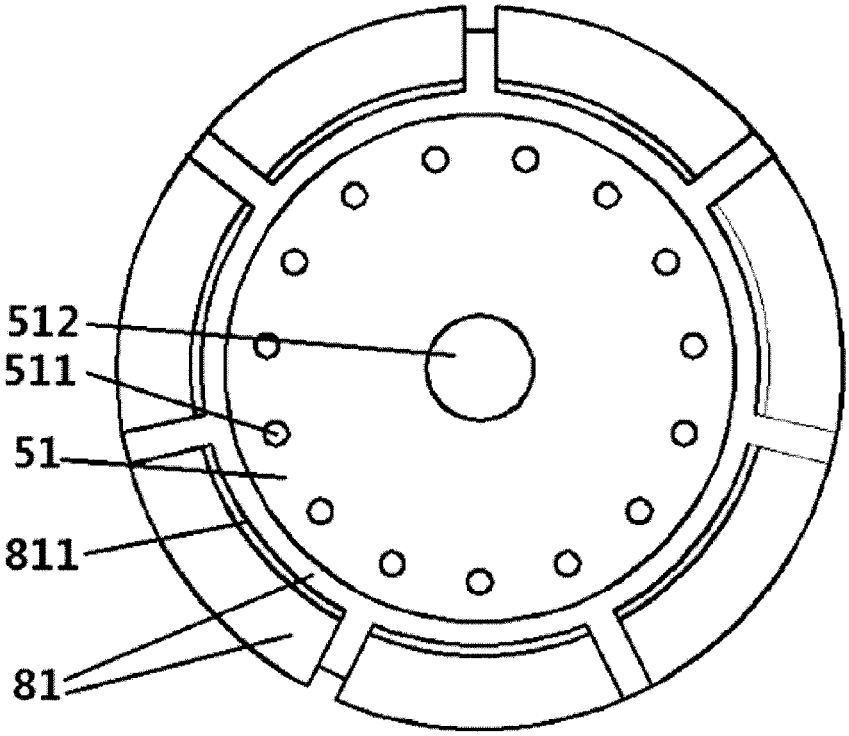
FIG. 4 is a rear view of a second embodiment of the present invention.
Figure 5:
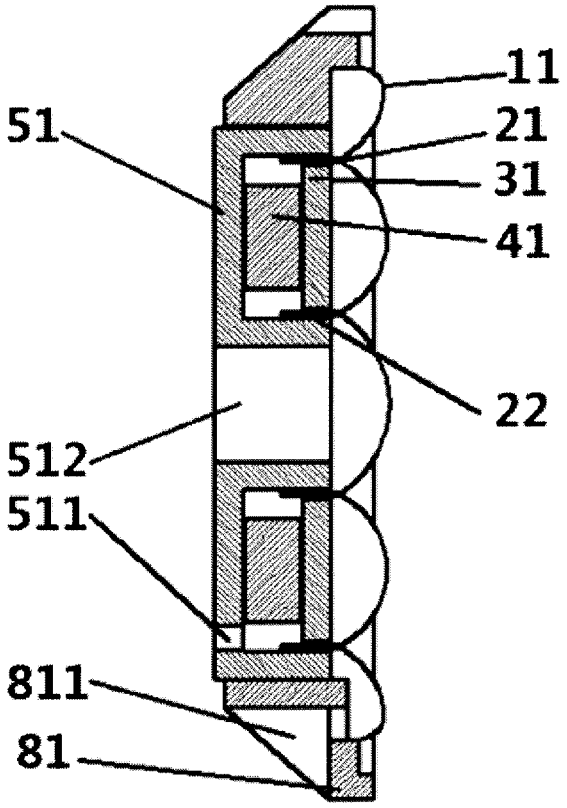
FIG. 5 is a broken view diagram of FIG. 5.

The present invention may also have other implementing embodiments. FIG. 4 and FIG. 5 show a second embodiment of the present invention. A hole 512 is arranged at the center of a U-shaped cup 51 and a plurality of holes 511 are arranged at the periphery. The U-shaped cup 51 and a diaphragm 11 are arranged on a bracket 81. A big voice coil 21 and a small voice coil 22 distributed in a concentric circle are arranged on the diaphragm 11. A large magnet 41 is arranged in the U-shaped cup 51, and a washer 31 is arranged on an upper surface of the magnet 41. Both the magnet 41 and the washer 31 are arranged between the big voice coil 21 and the small voice coil 22. The big voice coil 21 and the small voice coil 22 are respectively arranged in two gaps of a magnetic circuit system formed by the U-shaped cup 51, the magnet 41 and the washer 31. A gap between the large magnet 41 and the outer wall of the U-shaped cup 51 is corresponding to the hole 511 on the upper surface of the U-shaped cup 51, to form an air leakage path. When the diaphragm 11 is vibrating, the air at the back of the diaphragm is released through the holes 512 and 511, and a gap 811 on the bracket 81, in this way, air compression will not be caused when the diaphragm 11 is vibrating, thus being capable of reducing loudspeaker distortion.

Figure 6:
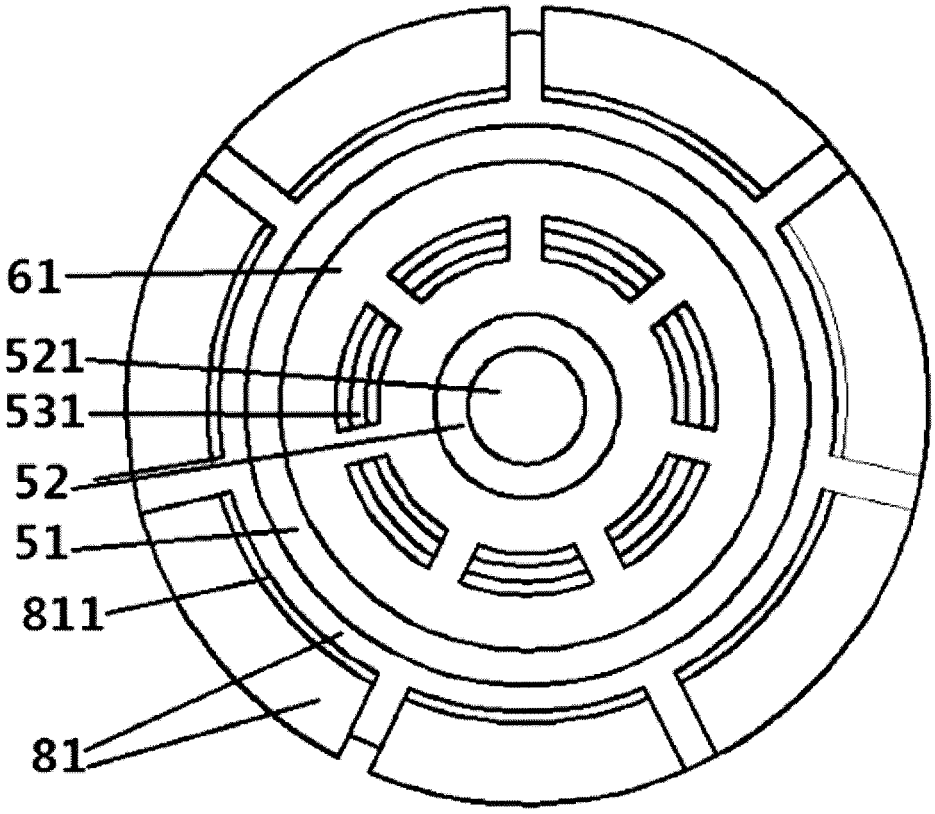
FIG. 6 is a rear view of a third embodiment of the present invention.
Figure 7:
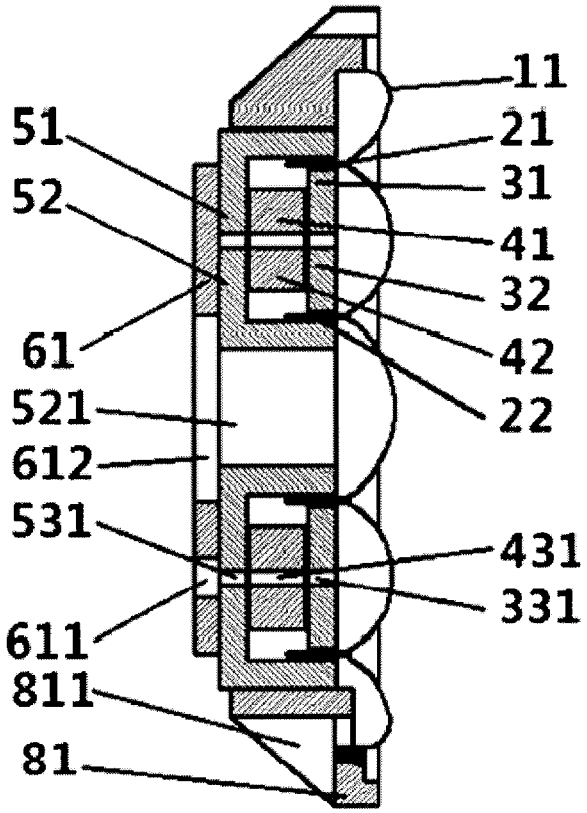
FIG. 7 is a broken view diagram of FIG. 6.

FIG. 6 and FIG. 7 show a third embodiment of the present invention. A big U-shaped cup 51 and a diaphragm 11 are arranged on a bracket 81, and the big U-shaped cup 51 and a small U-shaped cup 52 are distributed in a concentric circle and fixed through the supporting plate 61. A big voice coil 21 and a small voice coil 22 distributed in a concentric circle are arranged on the diaphragm 11. The large magnet 41 is arranged in the big U-shaped cup 51 and is located at the inside of a vertical post, the small magnet 42 is arranged in the small U-shaped cup 52 and is located at the outside of the vertical post, the big washer 31 and the small washer 32 distributed in a concentric circle are respectively arranged on the large magnet 41 and the small magnet 42. The large magnet 41, the small magnet 42, the big washer 31 and the small washer 32 are arranged between the big voice coil 21 and the small voice coil 22. The big voice coil 21 and the small voice coil 22 are respectively arranged in a gap of a big magnetic circuit system formed by the U-shaped cup 51, the large magnet 41 and the big washer 11, and a gap of a small magnetic circuit system formed by the small U-shaped cup 52, the small magnet 42 and the small washer 32. A gap 531 between the big U-shaped cup 51 and the small U-shaped cup 52, a gap 431 between the large magnet 41 and the small magnet 42, and a gap 331 between the big washer 31 and the small washer 32 are corresponding with each other, and are corresponding with a hole 611 on a supporting plate 61 to form an air leakage path. When the diaphragm 11 is vibrating, the air at the back of the diaphragm is released through the hole 512, the gaps 331, 431 and 531, the hole 611 and a gap 811 on the bracket 81, in this way, air compression will not be caused when the diaphragm 11 is vibrating, thus being capable of reducing loudspeaker distortion.

Figure 8:
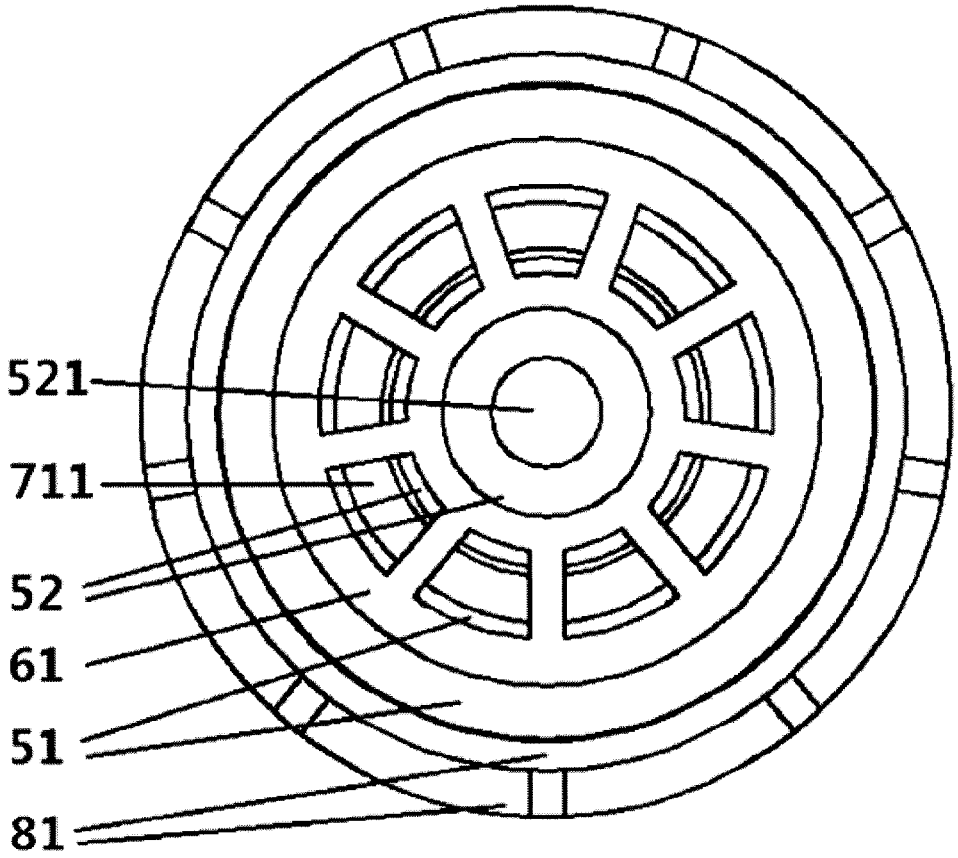
FIG. 8 is a rear view of a fourth embodiment of the present invention.
Figure 9:
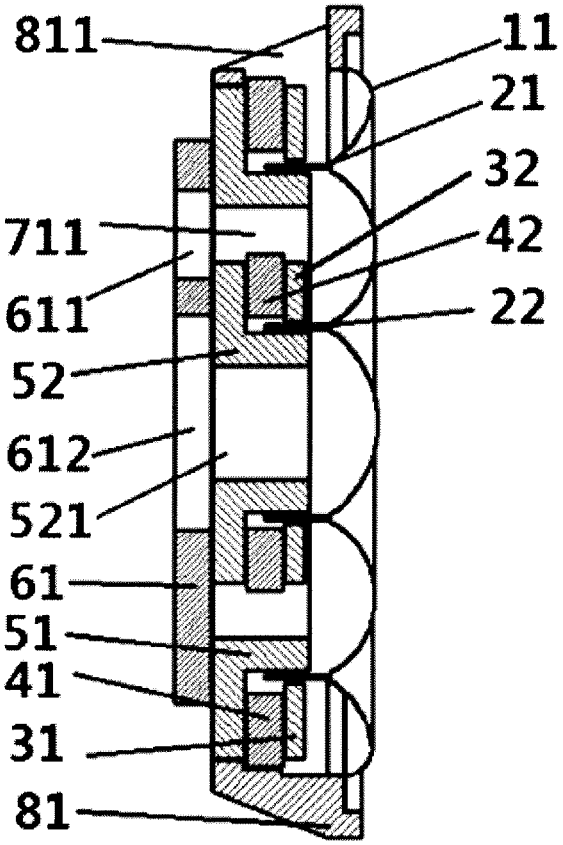
FIG. 9 is a broken view diagram of FIG. 8.

FIG. 8 and FIG. 9 show a fourth embodiment of the present invention. A big U-shaped cup 51 and a diaphragm 11 are arranged on a bracket 81, the big U-shaped cup 51 and a small U-shaped cup 52 are distributed in a concentric circle and fixed through the supporting plate 61. A big voice coil 21 and a small voice coil 22 distributed in a concentric circle are arranged on the diaphragm 11. A large magnet 41 and a small magnet 42 distributed in a concentric circle are respectively arranged in the U-shaped cup 51 and the small U-shaped cup 52 and are arranged outside a vertical post, and the big washer 31 and the small washer 32 distributed in a concentric circle are respectively arranged on the large magnet 41 and the small magnet 42. The large magnet 41 and the big washer 31 are arranged outside the big voice coil 21, and the small magnet 42 and the small washer 32 are arranged between the big voice coil 21 and the small voice coil 22. The big voice coil 21 and the small voice coil 22 are respectively arranged in a gap of a big magnetic circuit system formed by the U-shaped cup 51, the large magnet 41 and the big washer 11, and a gap of a small magnetic circuit system formed by the small U-shaped cup 52, the small magnet 42 and the small washer 32. A gap 711 between the big U-shaped cup 51, the small U-shaped cup 52, the small magnet 42 and the small washer 32 is corresponding to a hole 611 on the supporting plate 61, and a hole 521 at the center of the small U-shaped cup is corresponding to a hole 612 on the supporting plate 61, to respectively form an air leakage path. When the diaphragm 11 is vibrating, the air at the back of the diaphragm is released through the holes 521 and 612, the gaps 712 and 611, and a gap 811 on the bracket 81, in this way, air compression will not be caused when the diaphragm 11 is vibrating, thus being capable of reducing loudspeaker distortion.

Figure 10:
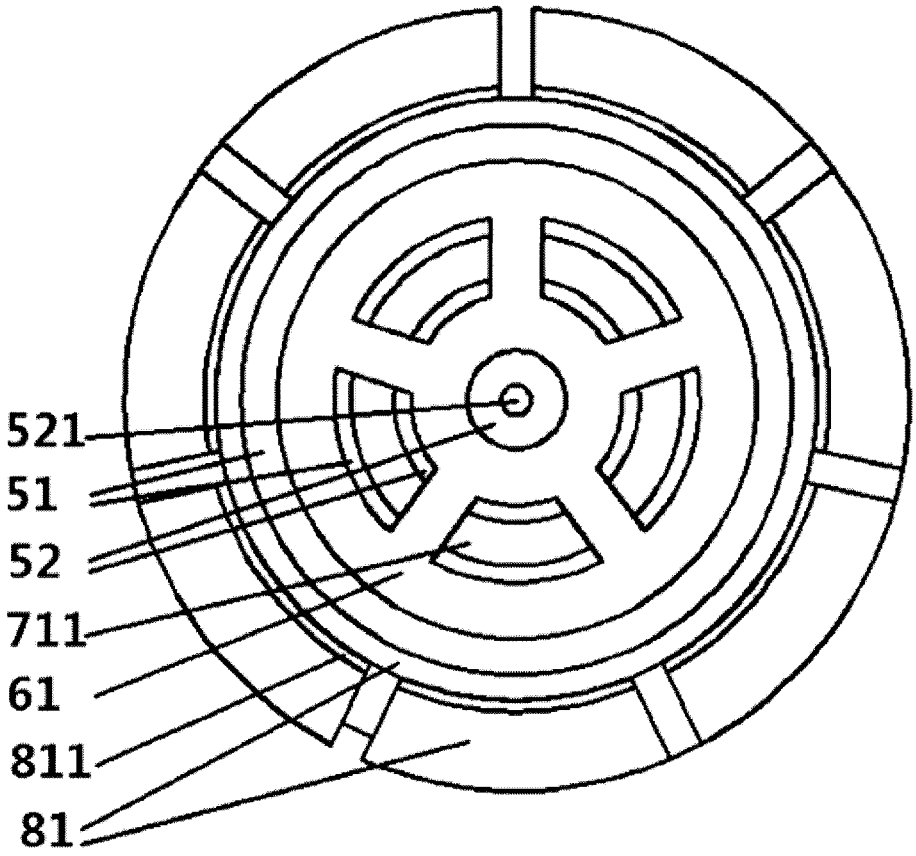
FIG. 10 is a rear view of a fifth embodiment of the present invention.
Figure 11:
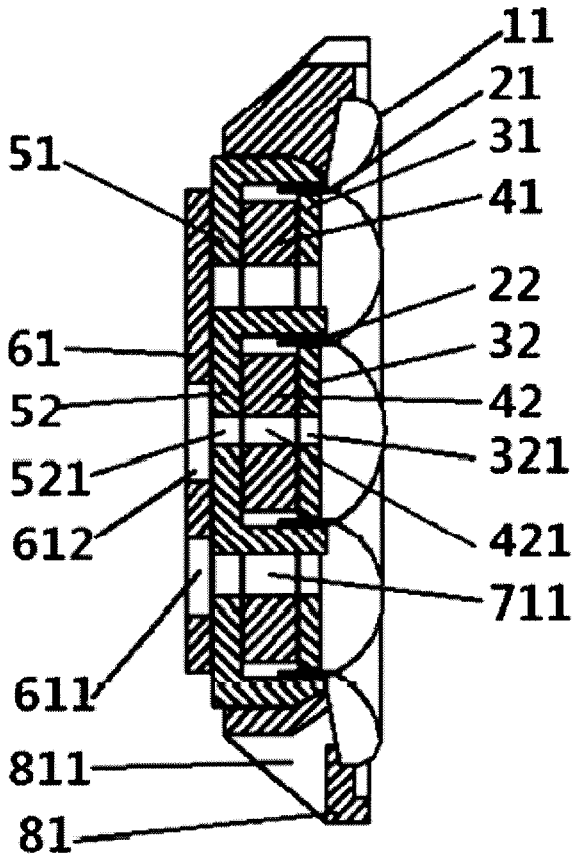
FIG. 11 is a broken view diagram of FIG. 10.

FIG. 10 and FIG. 11 show a fifth embodiment of the present invention. A big U-shaped cup 51 and a diaphragm 11 are arranged on a bracket 81, the big U-shaped cup 51 and a small U-shaped cup 52 are distributed in a concentric circle and fixed through the supporting plate 61. A big voice coil 21 and a small voice coil 22 distributed in a concentric circle are arranged on the diaphragm 11. A large magnet 41 and a small magnet 42 distributed in a concentric circle are respectively arranged in the U-shaped cup 51 and the small U-shaped cup 52 and are arranged inside a vertical post, and the big washer 31 and the small washer 32 distributed in a concentric circle are respectively arranged on the large magnet 41 and the small magnet 42. The large magnet 41 and the big washer 31 are arranged between the big voice coil 21 and the small voice coil 22, and the small magnet 42 and the small washer 32 are arranged inside the small voice coil 22. The big voice coil 21 and the small voice coil 22 are respectively arranged in a gap of a big magnetic circuit system formed by the U-shaped cup 51, the large magnet 41 and the big washer 11, and a gap of a small magnetic circuit system formed by the small U-shaped cup 52, the small magnet 42 and the small washer 32. A gap 711 between the small U-shaped cup 52, the big U-shaped cup 51, the large magnet 41 and the big washer 31 is corresponding to a hole 611 on the supporting plate 61; a hole 521 at the center of the small U-shaped cup 52, a hole 421 at the center of the small magnet, and a hole 321 at the center of the small washer are corresponding with a hole 612 on the supporting plate 61, to respectively form an air leakage path. When the diaphragm 11 is vibrating, the air at the back of the diaphragm is released through the holes 321, 421, 521 and 612, the gaps 711 and 611, and a gap 811 on the bracket 81, in this way, air compression will not be caused when the diaphragm 11 is vibrating, thus being capable of reducing loudspeaker distortion.

When in use, because a pressure discharge structure is employed, the present invention effectively solves the distortion problem which cannot be solved by a long term, improves the sound quality of the loudspeaker, has better market competition, and is beneficial for market popularization and application.

The invention claimed is:

1. A double-voice coil moving-coil loudspeaker, comprising:

a bracket, a big U-shaped cup fixed in the bracket, and a small U-shaped cup fixed to the big U-shaped cup through a supporting rack, wherein the big U-shaped cup includes a circular groove, a vibrating diaphragm fixed on the bracket at the position of the big U-shaped cup, a big voice coil and a small voice coil distributed in a concentric circle and arranged on the vibrating diaphragm, wherein a circular big magnet and a circular small magnet are distributed in a concentric circle arranged in the big U-shaped cup, a circular big washer arranged on an upper surface of the circular big magnet, and a circular small washer arranged on an upper surface of the circular small magnet, wherein the big voice coil and the small voice coil are respectively arranged in a big gap formed between the big U-shaped cup and the circular big washer and a small gap formed between the big U-shaped cup and the circular small washer, wherein the big U-shaped cup is provided with a first air vent and a second air vent, wherein a first gap is located between the circular big washer and the circular small washer, and wherein a second gap is located between the circular big magnet and the circular small magnet, wherein the first gap and the second gap are in communication with the second air vent distributed in a circular shape on the big U-shaped cup;

and wherein, the circular big magnet is arranged in the big U-shaped cup; the circular big washer is arranged on the upper surface of the circular big magnet; the circular small magnet is arranged outside the small U-shaped cup, the circular small washer is arranged on the upper surface of the circular small magnet, wherein a hole at the center of the small U-shaped cup is communicated with a hole at the center of a supporting rack;

wherein, the gap between the circular big washer and the circular small washer, the gap between the circular big magnet and the circular small magnet, and a gap between the big U-shaped cup and the small U-shaped cup are communicated, and are communicated with a hole circularly distributed on the supporting rack.

2. The double-voice coil moving-coil loudspeaker according to claim 1, wherein the circular big magnet is arranged in the big U-shaped cup, the circular big washer is arranged on the upper surface of the circular big magnet, the gap between an external side of the circular big magnet and an inner wall of the big U-shaped cup is communicated with the air vent distributed circularly on the big U-shaped cup.

3. The double-voice coil moving-coil loudspeaker according to claim 1, wherein the circular big washer and the circular small washer are combined integrally, and an air vent is arranged at a position corresponding to the gap between the circular big magnet and the circular small magnet, and the air vent is communicated with the gap.

4. The double-voice coil moving-coil loudspeaker according to claim 1, wherein the circular big magnet is arranged outside the big U-shaped cup, the circular big washer is arranged on the upper surface of the circular big magnet, and a gap between the inner wall of the big U-shaped cup, the small U-shaped cup, the circular small magnet and the circular small washer is communicated with the hole distributed circularly on the upper surface of the supporting rack.

5. The double-voice coil moving-coil loudspeaker according to claim 1, wherein the circular small magnet is arranged in the small U-shaped cup; the circular small washer is arranged on an upper surface of the circular small magnet; a gap between the outer wall of the small U-shaped cup, and the big U-shaped cup, the circular big magnet and the circular big washer is communicated with the hole circularly distributed on the supporting rack; the hole at the center of the small U-shaped cup, a hole at the center of the circular small magnet, and a hole at the center of the circular small washer are communicated, and are communicated with the hole at the center of the supporting rack.

* * * * *